United States Patent [19]

Whitney

[11] Patent Number: 4,668,458

[45] Date of Patent: May 26, 1987

[54] METHOD OF FORMING A CARBONATED BEVERAGE PACKAGE

[75] Inventor: Ralph H. Whitney, Crawfordsville, Ind.

[73] Assignee: Owens-Illinois, Inc., Toledo, Ohio

[21] Appl. No.: 818,623

[22] Filed: Jan. 14, 1986

[51] Int. Cl.[4] ..... B65D 41/04

[52] U.S. Cl. ..... 264/249; 215/329; 215/351

[58] Field of Search ..... 215/329, 327, 349, 351; 264/249

[56] References Cited

U.S. PATENT DOCUMENTS

| | | | |
|---|---|---|---|
| 2,162,880 | 6/1939 | Brown | 215/330 |
| 4,351,443 | 9/1982 | Uhlig | 215/216 |
| 4,381,840 | 5/1983 | Ostrowsky | 215/329 |
| 4,423,821 | 1/1984 | McIntosh | 215/329 |

*Primary Examiner*—Donald F. Norton
*Attorney, Agent, or Firm*—John R. Nelson

[57] ABSTRACT

A carbonated beverage package comprising a bottle having a neck with an external thread and a closure comprising a base wall and a peripheral skirt having an internal thread interengaging the thread on the neck. A flexible liner is interposed between the interior surface of the base wall of the closure and the open end of the neck. The closure is made of plastic and includes a portion at the juncture of the base wall and peripheral skirt which is axially deformable relative to the remainder of the base wall to a permanent shape. When the closure is applied to the ncek and the closure is rotated by relative rotation between the closure and the neck while simultaneously an axial force is applied to the deformable portion of the cap, the deformable portion is displaced axially relative to the base wall to a permanent shape causing the liner to be deflected about a portion of the outer surface of the neck adjacent the open end of the neck thereby increasing the contact of the liner with the neck.

2 Claims, 4 Drawing Figures

METHOD OF FORMING A CARBONATED BEVERAGE PACKAGE

This invention relates to carbonated beverage packages and particularly to containers such a bottle which has a threaded closure.

BACKGROUND AND SUMMARY OF THE INVENTION

It has heretofore been proposed that a plastic closure be used on the threaded open neck of a container such as a bottle to provide a seal for carbonated beverages. One of the basic problems is the limited sealing area on the open end of the neck which is engaged by the closure.

It has heretofore been suggested that plastic closures be formed that deflect or reshape a liner into sealing engagement with the neck of the container. Typical arrangements are shown in U.S. Pat. Nos. 4,351,443, 4,381,840 and PCT Patent Document No. 82/02181. U.S. Pat. No. 4,351,443 shows an arrangement which relies on the configuration previously formed on the base wall of the closure for deflecting the liner against the inside surface of the neck or the outside surface of the neck. U.S. Pat. No. 4,381,840 shows an arrangement wherein projections on the inner surface of the base wall of the closure compress the liner against the free end of the finish. PCT Patent Document No. 82/02181 shows an internal bead at the inside corner of the closure for reforming the liner around the corner radius of the finish. Such arrangements are more difficult to make. In addition, such arrangements often do not accommodate variations in the bottle finish diameter.

Accordingly, among the objectives of the present invention are to provide a carbonated beverage package which has improved sealing characteristics; which provides such characteristics at minimal cost, and which can be readily manufactured, and which accommodate variations in the container or bottle finish diameter.

In accordance with the invention, a carbonated beverage package embodying the invention comprises a bottle having a neck with an external thread and a closure comprising a base wall and a peripheral skirt having an internal thread interengaging the thread on the neck. A flexible liner is interposed between the interior surface of the base wall of the closure and the open end of the neck. The closure is made of plastic and includes a portion at the juncture of the base wall and peripheral skirt which is axially deformable relative to the remainder of the base wall to a permanent shape such that when the closure is applied to the neck and the closure is rotated by relative rotation between the closure and the neck while simultaneously an axial force is applied to the deformable portion of the cap, the deformable portion is displaced axially relative to the base wall to a permanent shape causing the liner to be deflected about a portion of the outer surface of the neck adjacent the open end of the neck thereby increasing the contact of the liner with the neck.

DESCRIPTION

Figure 1:
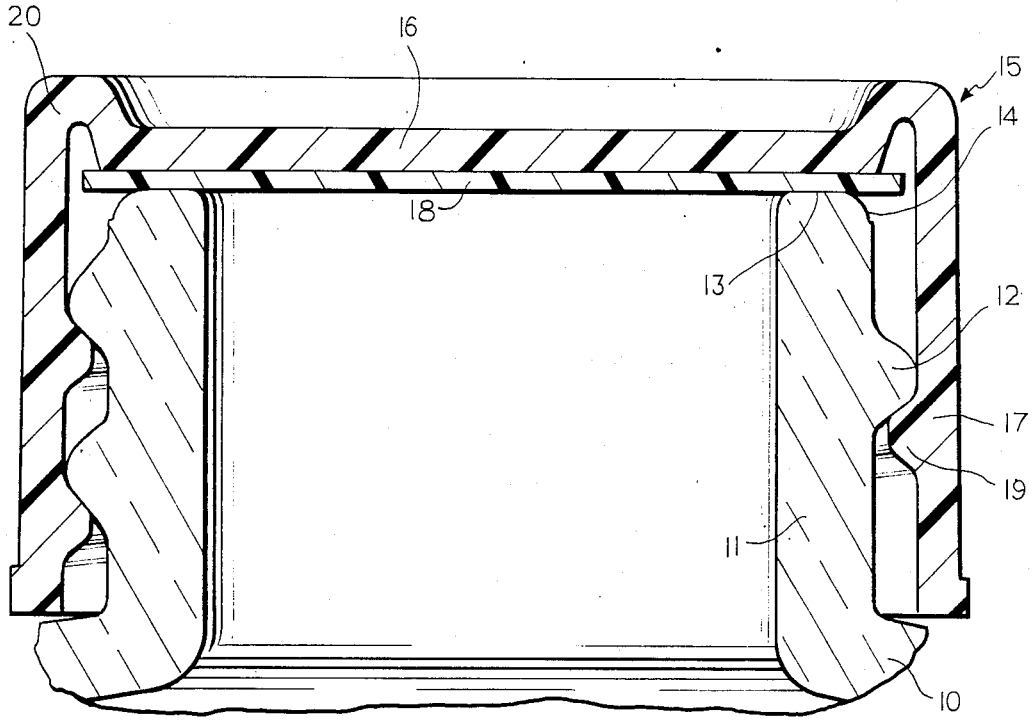
FIG. 1 is a fragmentary vertical sectional view of a carbonated beverage package showing the relative position of the parts during closing.

Referring to FIG. 1 the carbonated beverage package embodying the invention comprises a container 10 such as a plastic or glass bottle having a neck 11 with an external threaded portion 12 and an open end having a generally flat transverse surface 13 and an arcuate outer edge 14 at the juncture of the surface 13 and the outer surface of the neck 11. The package further includes a plastic closure 15 that has a base wall 16 and a peripheral skirt 17. The inner surface of the peripheral skirt is formed with threads 19 complimentary to the threads 12 of the container.

A soft flexible substantially flat liner 18 is positioned along the inner surface of the base wall 16. The diameter of the liner 18 is greater than the outer diameter of the neck 11 of the container adjacent the surface 13 and less than the inner diameter of the skirt 17 of the closure.

In accordance with the invention, the closure 15 includes an annular portion 20, at the juncture of the base wall 16 and peripheral skirt 17, which is generally inverted U-shaped in cross section such that it is deformable axially relative to the base wall 16 to a permanent and different shape.

Figure 2:
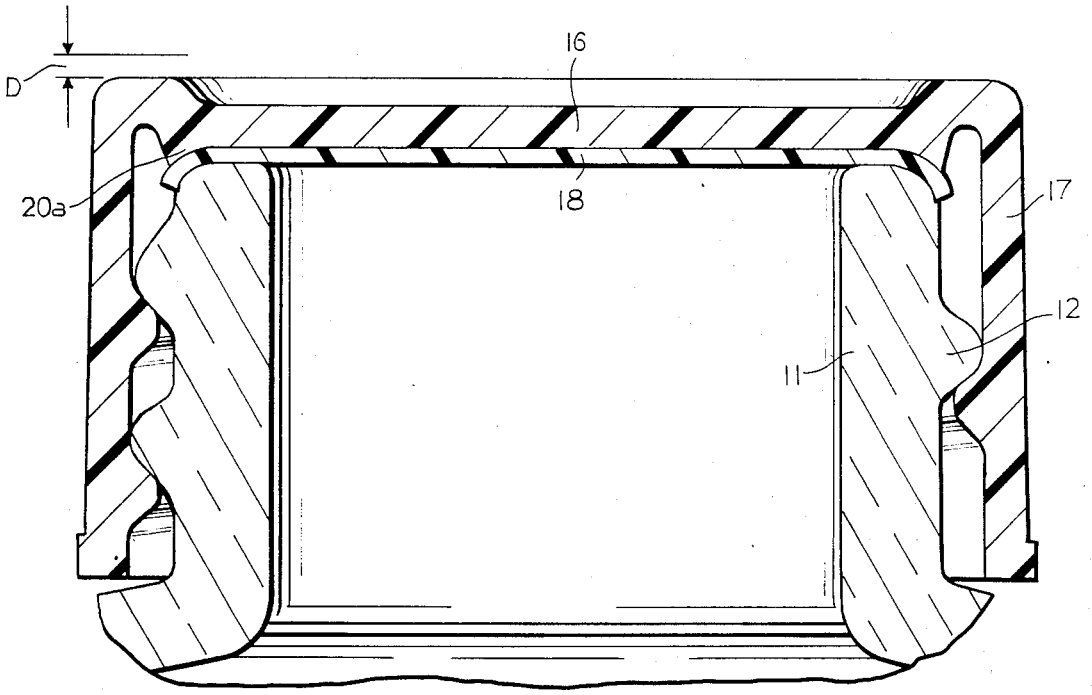
FIG. 2 is a view similar to FIG. 1 showing the relative positions of the parts after the closure has been fully applied.

When the closure 15 with the liner 18 in position is applied to the neck 11, an axial force is applied to the annular portion 20, as indicated by the arrows in FIG. 1, as by an annular mandrel, while the closure is rotated relative to the container. This causes the portion 20 to be deformed permanently as shown in FIG. 2 by the distance D. During this deformation the deformed portion 20 assumes the configuration as shown in FIG. 2 including an axially projecting portion **20*a* on the inner surface of the base wall 16, spaced from the skirt 16, which applies a force to the liner 18 causing the liner 18 to be deflected about the outer surface 14 on the neck 11 thereby increasing the sealing contact of the liner 18 with the neck. As the axial force continues, the skirt 17 will tend to be displaced axially relative to the base wall 16 but the continued relative rotation between the closure 15 and the container 10 will cause the skirt 17 and in turn, the closure 15 to be tightened on the threads to take up any relative displacement. The resultant carbonated beverage package thereby forms a more effective seal on the top and side of neck 11**.

In a typical example, the closure may be made of a material that can be permanently deformed without cracking and may comprise high density polyethylene or polypropylene. The liner must be made of a material capable of accommodating finish surface conditions and dimensional tolerances and may comprise EVA or polyvinyl chloride. The container may be made of glass or plastic such as polyethylene terephthlate.

Figure 3:
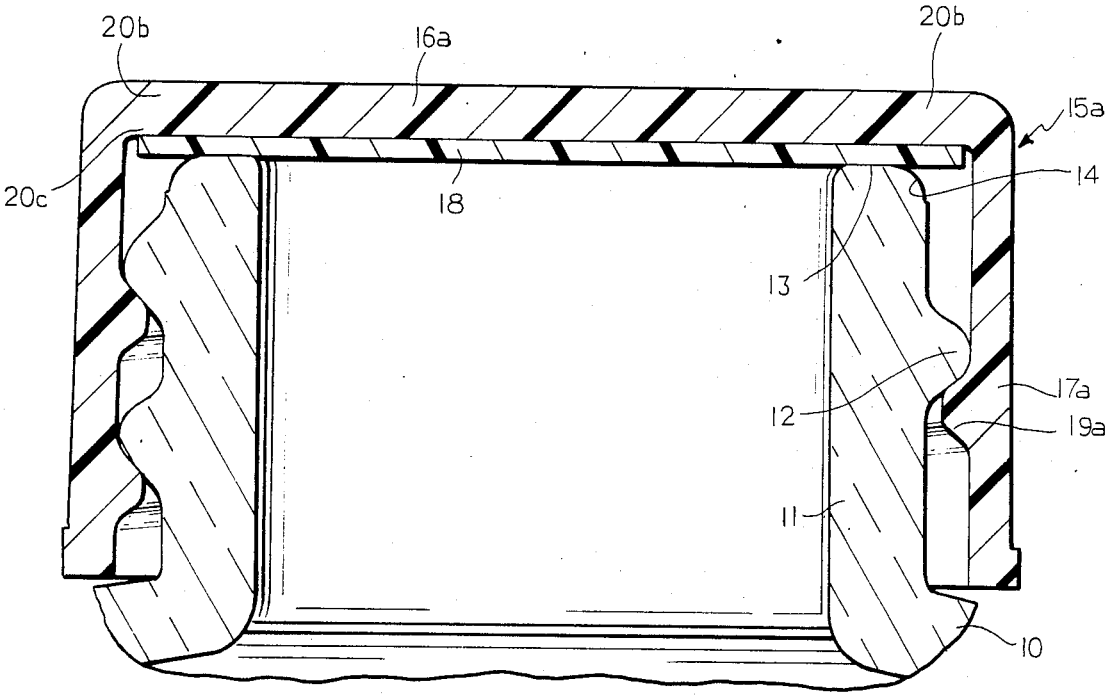
FIG. 3 is a view similar to FIG. 1 of a modified form of carbonated beverage package.
Figure 4:
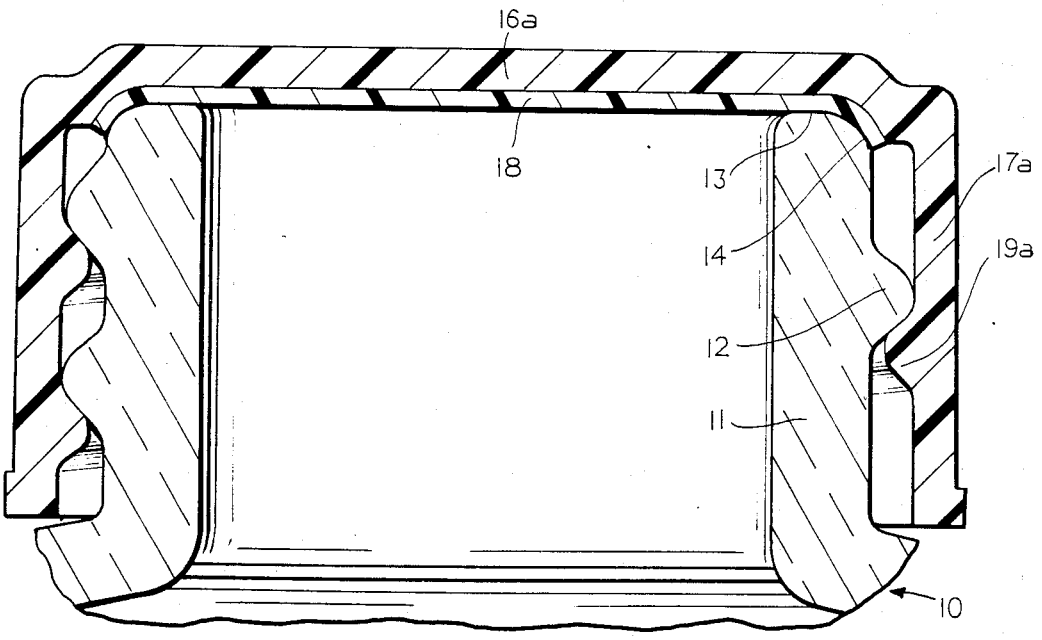
FIG. 4 is a sectional view showing the relative positions of the parts after the closure has been applied.

In the form of the invention shown in FIGS. 3 and 4, the base wall **16*a* is of substantially uniform thickness throughout and the outermost portion thereof defines a deformable portion 20*b*. As the annular force is applied during the application of the closure, the portion 20*b* is deformed axially relative to the liner and skirt. The closure 15*a* is applied by rotation and an axial force in the same manner and the portion 20*b* becomes deformed so that the liner is deflected about the surface 14. In the final configuration as shown in FIG. 4, the base wall 16*a*** engages the upper surface of the liner and the portion 20*c* at the juncture of the base wall 16*a* and skirt 17 has been deformed, the plastic merging with the base wall 16*a* and peripheral skirt 17*a* to seal the end and side of the neck 11.

It can thus be seen that there has been provided a package and closure which result improved sealing characteristics that are obtained at minimal costs, can be readily manufacture, and will accommodate variations in diameters of the container.

I claim:

1. The method of forming a carbonated beverage package comprising forming a bottle having a neck with an external thread, forming a plastic closure with a base wall and a peripheral skirt having an internal thread adapted to interengage the thread on the neck of the container, forming a flexible liner interposed between the interior surface of the base wall of the closure and the open end of the neck, said closure being made of plastic that can be permanently deformed and including a portion at the juncture of the base wall and peripheral skirt which is axially deformable relative to the remainder of the base wall, applying the closure to the container by relative rotation between the closure and the neck, applying an axial force to the deformable portion of the cap such that the deformable portion is permanently displaced axially relative to the base wall causing the liner to be deflected about a portion of the outer surface of the neck adjacent the open end of the neck thereby increasing the contact of the liner with the neck.

2. The method set forth in claim 1 including forming said deformable portion of said closure in generally inverted U-shaped cross section.

* * * * *